United States Patent [19]

Samuels

[11] 4,190,738

[45] Feb. 26, 1980

[54] MODULAR FURNITURE STRUCTURE

[76] Inventor: George A. Samuels, 8350 S. Bennett, Chicago, Ill. 60617

[21] Appl. No.: 875,698

[22] Filed: Feb. 6, 1978

[51] Int. Cl.[2] ..... H04R 1/20; A47B 47/00

[52] U.S. Cl. ..... 179/1 E; 181/199; 211/183; 211/189; 312/253

[58] Field of Search ..... D6/20, 23, 24, 85, 157, D6/181, 186, 187; D14/33, 34, 38; 108/91; 179/1 E, 146 E; 181/148, 156, 199; 211/183, 189; 214/10.5 R; 248/356; 312/253, 256

[56] References Cited

U.S. PATENT DOCUMENTS

| | | | |
|---|---|---|---|
| D. 183,991 | 11/1958 | McCartan | D6/20 |
| 921,855 | 5/1909 | Loskamp | 214/10.5 R |
| 2,118,641 | 5/1938 | Diamond | 214/10.5 R |
| 2,136,843 | 11/1938 | Dinkel | 312/253 |
| 2,246,448 | 6/1941 | Mahan, Jr. | 214/10.5 R |
| 2,425,911 | 8/1947 | Anderson | 214/10.5 R |
| 2,589,718 | 3/1952 | Martin | 214/10.5 R |
| 2,849,027 | 8/1958 | Tetyak | 214/10.5 R |
| 2,991,040 | 7/1961 | Levy | 248/356 |
| 3,230,910 | 1/1966 | Olsson | 108/91 |
| 3,280,527 | 10/1966 | Faust | 248/356 |
| 3,672,723 | 6/1972 | Decursu et al. | 108/91 |
| 4,008,935 | 2/1977 | Zeloyle | 312/252 |
| 4,068,761 | 1/1978 | McCarthy | 248/356 |

FOREIGN PATENT DOCUMENTS

| | | | |
|---|---|---|---|
| 2144736 | 3/1973 | Fed. Rep. of Germany | 179/1 E |
| 2234612 | 1/1974 | Fed. Rep. of Germany | 108/91 |
| 109966 | 2/1940 | United Kingdom | 181/156 |

OTHER PUBLICATIONS

Stereo Review Jun. 1975 p. 12, "Rectilinear 5 Speaker System".

*Primary Examiner*—George G. Stellar

*Attorney, Agent, or Firm*—Hill, Van Santen, Steadman, Chiara & Simpson

[57] ABSTRACT

Modular furniture structure in which one or more modular pillar blocks have supportive engagement with modular articles of furniture wherein at least one of the top and bottom load bearing surfaces of each pillar block has a recessed seat for receiving the complementary surface of the modular article of furniture.

19 Claims, 8 Drawing Figures

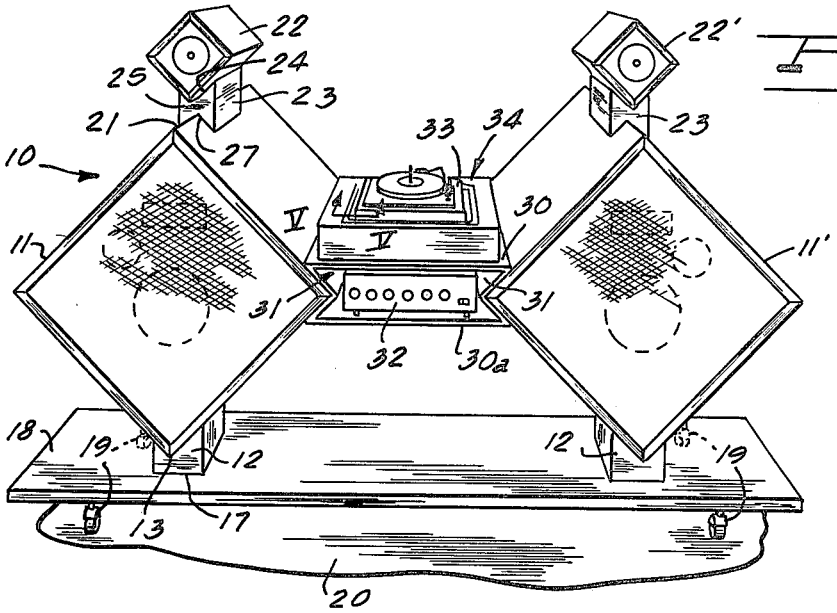
Fig. 1
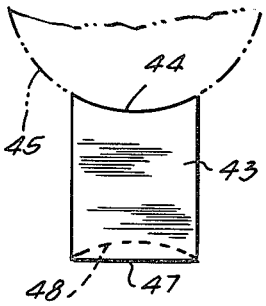
Fig. 3
Fig. 4
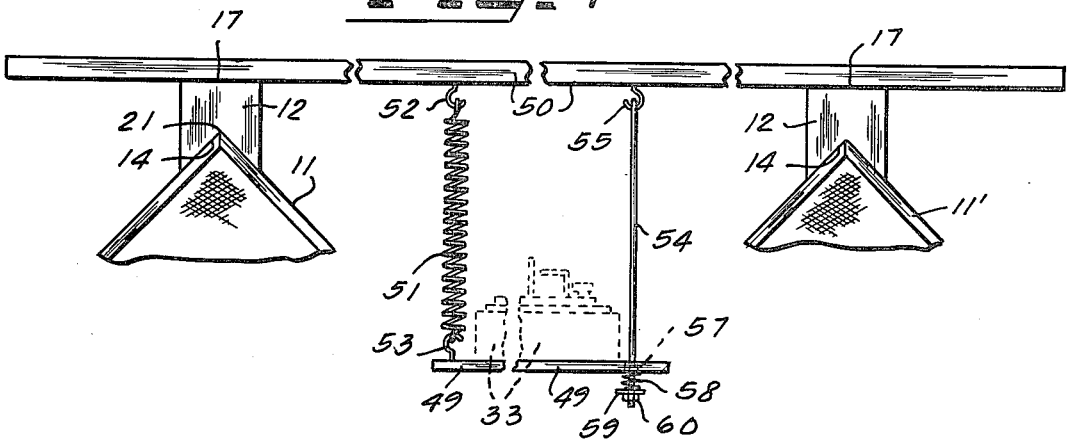
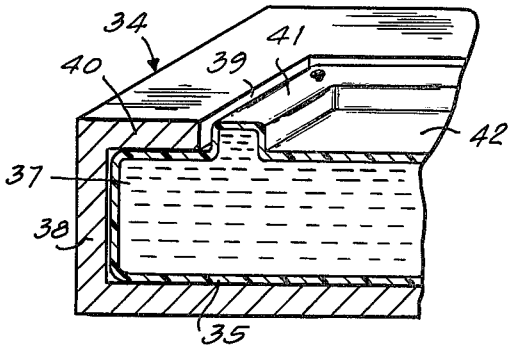
Fig. 5
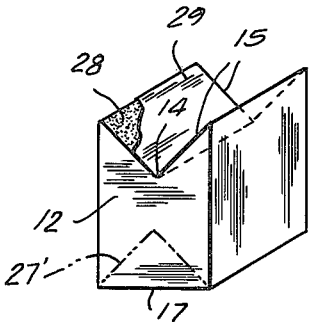
Fig. 2

MODULAR FURNITURE STRUCTURE

This invention relates to modular furniture structure, and is more particularly concerned with such a structure adapted for attainment of a wide variety of useful and attractive modular furniture arrangements.

For efficiency modular articles of furniture such as stereo equipment including speaker units, shelving, nicknack receptacles, and the like should be located not only in the most functional orientation in a room but should also occupy the allotted space to good advantage. Such articles of furniture most often have geometric shapes presenting external angles, but may sometimes have curvate external shapes. Heretofore stereo combinations have generally merely been placed on tables or shelf support or mounted in special and often expensive cabinets. Ingenious stereo enthusiast will often construct special cabinets or housings for stereo equipment.

An important object of the present invention is to provide new and improved modular furniture structure enabling efficient, convenient, easy and attractive supporting and placement of modular articles of furniture in a generally building block manner.

Another object of the invention is to provide in modular furniture structure a new and improved modular pillar block for convenient stacking cooperation with modular articles of furniture.

A further object of the invention is to provide a new and improved modular furniture structure providing for a wide variety of permutations in assembling modular articles of furniture.

According to an embodiment of the invention, a modular furniture structure comprises a modular pillar block having top and bottom load bearing surfaces, and one of the surfaces has a recessed seat for supportive engagement with a complementary surface of a modular article of furniture.

According to the invention there may be provided various combinations of geometric modular articles and shelving for utmost efficiency in use of room space.

Further according to the invention, modular articles of furniture are provided comprising improved stereo equipment.

According to the principles of the present invention there is provided a modular furniture structure, comprising a modular pillar block having top and bottom load bearing end surfaces and at least a pair of opposite upright faces adapted to face forwardly and rearwardly respectively, and at least one of said load bearing end surfaces having a recessed channel-like seat extending entirely substantially straight across said one surface and opening at its opposite ends through said faces and adapted for stable supportive engagement with complementary surface area of a modular article of furniture of such dimensions that, when said complementary surface area is received in said seat, portions of the article of furniture can project freely from and beyond the opposite ends of said channel-like seat and in overhanging relation to said opposite faces.

Numerous and varied arrangements of modular furniture are enabled by use of the described modular pillar block, such as stacked arrangements, companion side-by-side arrangements, arrangements whereby shelf structure is advantageously supported by articles of furniture supported on modular pillar blocks, sound reproducing units are adapted to be supported in advantageous manner by and between speaker units, etc.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure and in which:

FIG. 1 is a perspective view of a modular furniture structure comprising a stereo assembly.

FIG. 2 is an isometric representation of a modular pillar block according to the invention.

FIG. 3 is an elevational view of a modified form of the pillar block.

FIG. 4 is a fragmental front elevational view of a modified modular stereo arrangement.

FIG. 5 is an enlarged fragmentary sectional detail view taken substantially along the line V—V in FIG. 1.

Figure 6:
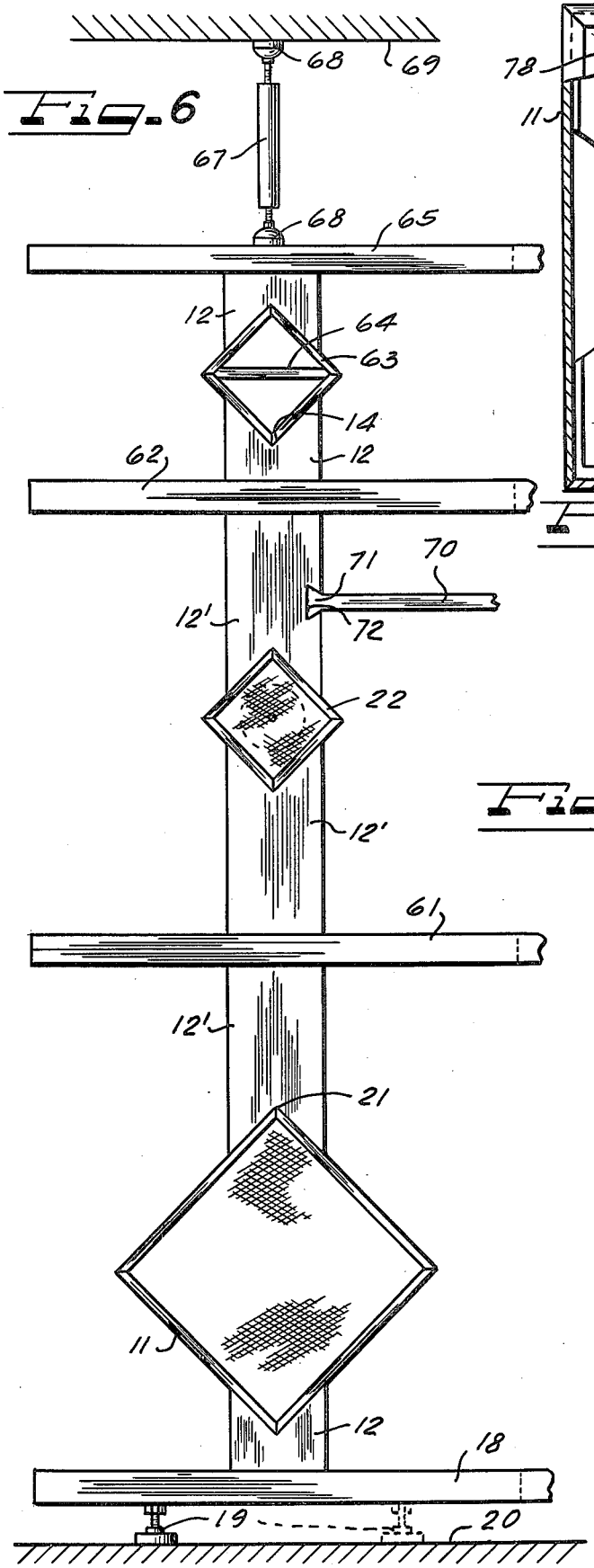
FIG. 6 is a fragmental front elevational view of an assembly comprising a plurality of modular articles of furniture and shelving in a floor to ceiling modular assembly.

Modular furniture structure in accordance with the present invention may be embodied in a high fidelity or stereo assembly 10 (FIG. 1) comprising at least one modular article of furniture 11, e.g. a stereo speaker cabinet, supported on a modular pillar block 12. Although geometric configurations of speaker cabinets may vary, a usual design, as shown for the article 11 is generally cubical having at least one outside corner 13 providing a complementary surface for supportive engagement in a recessed seat 14 at one end, here the top end of the pillar block 12, such seat being for this purpose of generally V-shape having convergently related substantially equal load bearing surfaces 15 of substantial width and depth and adequate for replaceably seating the corner 13 of the article 11 and engaging the complementary surfaces of the article at each side of the corner 13 whereby to support the article 11 in a stable manner. On its opposite end, the pillar block has a load bearing surface 17 which may be flat as shown in FIGS. 1 and 2 for stable supportive engagement with a supporting surface such as a floor, but more desirably a platform 18 which has leveling adjustment casters or feet 19 at properly spaced intervals thereon to permit accurate leveling of the supporting surface of the platform to compensate wherein the surface variables in an underlying floor 20.

Where the article 11 is of generally cubical form as shown it has an upper outside corner 21 of generally V-shape allochiral to the lower seated corner 13. This provides an upper supporting surface on the article 11 upon which another modular article of furniture 22 such as a small speaker unit may be supported replaceably by means of a pillar block 23. For this purpose, the pillar block 23 is provided with an upper V-shape recessed seat 24 for supportive engagement with a complementary surface 25 defined by a lower outside corner of the article 22. At its lower end, the pillar block 23 is provided with a downwardly opening generally V-shaped recessed seat 27 for supportive engagement with the upper corner 21 of the article 11. By having the surfaces defining the seats 24 and 27 joining at right angles and of adequate area, firm support of the block 23 on the right angular corner 21 is attained and also firm support of the article 22 is attained by the complementary engagement of its lower right angular corner 25 in the seat 24. By way of example, the dot dash line 27' in FIG. 2 represents how the pillar block 12 may readily be converted into the pillar block 23 by providing recessed seats at each end of the block. It will be understood, of course, that where a person wishes to arrange an assembly according to FIG. 1, of permutations thereof, a set of requisite number of the blocks 12 or of the blocks 12 and blocks 23 may be acquired and utilized for the purpose. Although the load bearing surfaces at either or both ends of the blocks 12 and 23 may be plain, they may be provided with anti-slip means such as pressure sensitive adhesive 28 (FIG. 2) normally covered by a protective sheet 29 that is adapted to be stripped off before the block is assembled with the surface to be engaged therewith. Instead of the adhesive 28, the load bearing surfaces or any of them, may be equipped with anti-friction rubber or rubber like material. Velcro fastener, or the like. If it is desired to retain the block 12 positively against movement relative to the platform 18, suitable nail or screw type fastener means may be employed.

As will be observed in FIGS. 1 and 2, the pillar blocks 12 and 23 have the recessed channel-like seats 14, 24, 27 extending entirely substantially straight across the load bearing end surfaces of the blocks. The seats open at opposite ends through opposite upright faces of the blocks adapted to face forwardly and rearwardly, respectively. Thereby, the seats are adapted for stable supportive engagement with complementary surface area of the modular articles of furniture which may be of such dimensions that, when the complementary surface areas are received in the seats, portions of the article of furniture can project freely from and beyond the opposite ends of the channel-like seats and in overhanging relation to the opposite faces through which the seats, in each instance, open. This provides a highly advantageous relationship permitting a wide variety of modular furniture permutations, a few representative examples of which have been disclosed herein.

Although the modular article 11 may stand alone or in association with the article 22 supported thereon, it may also, as shown in FIG. 1, be mounted in association with a companion like article 11' mounted on one of the pillar blocks 12 and may support on its upper corner an article 22' similar to the article 22 on one of the pillar blocks 23. By thus supporting the articles, i.e., speaker cabinets 11 and 11' on the level platform 18, permits the articles 11 and 11' to support between them a shelf structure 30 which may be simply a single shelf mounted in supported relation on the convergently related upper inside surfaces of the modular article cabinets 11 and 11', or the shelf structure may comprise a double shelf including a lower shelf 30*a* joined to the upper shelf 30 along each side by means of a generally V-shaped laterally opening bearing slide 31 complementary to and supportively engaged with the adjacent confronting corners provided by the articles 11 and 11'. Through this arrangement, the shelf structure 30,30*a* can be readily slidably engaged into position or removed as desired.

Conveniently, the shelf structure 30,30*a* may be used to support stereo equipment such as a receiver nut 32 which may be mounted in the space between the shelves 30 and 30*a*. On the top shelf 30, may be mounted a record player 33. To prevent transmission of vibrations to or from the speaker 11 and 11' and the record player 33, a vibration isolating mount 34 may be provided which in a desirable form comprises a water bed type device 35 (FIG. 5). This device comprises a flexible liquid-proof envelope containing a suitable liquid 37 such as oil or water dimensioned to fit inside a retaining cabinet 38 having a top opening 39 defined by an overhanging retaining flange 40. In the example shown, the opening 39 is substantially rectangular complementary to the substantially rectangular form of the record player base and adapted to accommodate an upstanding hollow liquid filled isolation rib 41 on the top of the envelope of the cushion device 35 and extending upwardly about a seat 42 within which the base of the record player is received. Through this arrangement, the record player is floatingly carried by the device 35 within the opening 39 and isolated from the edge defining the opening by the isolation rib 41. The cabinet 38 maintains the device 35 true to form when subject to the weight of the record player 33. If preferred, of course, the vibration isolating device 35 may comprise a pneumatic pillow instead of a water bed.

Where a drum style speaker unit must be supported, a pillar block 43 (FIG. 3) may be provided which has a load bearing surface formed with a concave recess seat 44 complementary to the external drum cabinet surface of a drum speaker unit as indicated by the dash outline 45. On its opposite end, the pillar block 43 may be provided with a flat bearing surface 47 or a concave generally cylindrical bearing surface 48 similar to the surface 44. On the other hand, if preferred, one end of the pillar block 43 may be provided with the concave seating surface 44 and on its opposite end with a V-shaped seat similar to the seat 27 of the block 23.

Instead of supporting the record player 33, or other apparatus, in the manner depicted in FIG. 1, a vibration isolating support for the apparatus 33 may be provided by means of a floating shelf 49 (FIG. 4) suspended in substantially vibration damped relation from a headboard 50 mounted in bridging relation on and between the articles 11 and 11' on inverted ones of the pillar blocks 12 which engage with their V-shaped seats 14 on the upper corners of the articles 11 and 11' while the opposite flat bearing surfaces 17 support the headboard 50. Suspension of the shelf 49 may be by either or both of the spring suspension devices illustrated one of which comprises a coiled tension spring 51 connected at its upper end to a hook 52 attached to the board 50 and connected at its opposite or lower end to a hook 53 attached to the shelf 49. The other suspension means illustrated comprises a rod 54 which may be connected to the board 50 by means of a hook 55 and extends downwardly through a suitable aperture 57 in the shelf 49 and to a sufficient distance therebelow to accommodate a coiled cushioning, vibration damping compression spring 58 on which the shelf 57 rests and which spring has its opposite end engaged on a washer 59 secured in place on the lower end portion of the rod 54 as by means of a nut 60. It will be understood, of course, that the shelf 49 will be of sufficient area to accommodate the apparatus 33, and that to support the shelf 49 in stable relation, a plurality of the suspension devices, whether the spring 51 or the rod 54 or a mix of the same will be located at suitable spaced intervals to provide stable support for the shelf 49. In this manner vibrations from the articles 11 and 11', i.e., speaker units, will be isolated from the apparatus 33, i.e., record player, and also any vibrations that may occur in the apparatus 33 will be isolated from the articles or units 11 and 11'.

As will be apparent, available space on the platform 18 may be used for record storage or other purposes. The headboard 50 may serve as an article receiving shelf. Where the headboard 50 is used, if small speaker units auxiliary to the larger units 11 and 11' are desired, they may be supported on the platform 18 or on the headboard 50, as preferred.

Representative of the versatility and various utilitarian arrangements to which the present invention lends itself, is the combination modular furniture article and shelving assembly of FIG. 6. In this arrangement the platform 18 supports the modular article of furniture 11 by means of the pillar block 12. On the upper corner 21 of the article 11 is mounted a pillar block 12' which is an inverted version of the pillar block 12 but may be slightly longer. Mounted on the flat bearing surface of the pillar block 12' is a shelf panel 61. Stacked on the shelf 61 above the pillar block 12' is a second pillar block 12' with its flat bearing surface on the shelf 61 and its recessed seat bearing surface facing upwardly and supporting the small speaker unit 22. Stacked on the article 22 is another of the pillar blocks 12' with its V-shaped recessed seat engaging on the upwardly projecting corner of the article 22 and its flat bearing surface supporting a second shelf 62. Stacked on the shelf 62 in line with the pillar blocks 12' is one of the pillar blocks 12 with its flat bearing surface on the shelf 62 and its recessed seat 14 supportively engaged by a rectangular article 63 which may be hollow and may support a nicknack shelf 64 therein. Stacked on the article 63 is one of the pillar blocks 12 with its recessed seat supportively engaged on the article 63 and its flat bearing surface supporting a top shelf 65. The stacked arrangement in FIG. 6 may comprise a single column, wherein the platform 18 and the shelves 61, 62 and 65 may be of substantially the same size and centrally aligned in the stack, the right hand edges of the platform and shelves being indicated by vertical dash lines. On the other hand the arrangement lends itself especially well to an arrangement of substantially greater width in which the shelves span between two vertical stacked columns of the modular pillar blocks. In other words, one or more of the stacked pillar blocks, and intervening modular articles of furniture as depicted in FIG. 6 will in the wider span arrangement support the shelving at one or more spaced intervals, depending on the length of shelving desired.

For utmost stability, means may be provided for thoroughly anchoring stacked assembly against displacement. For example, a generally turnbuckle type of expansion screw device 67 may be provided wherein opposite engagement pads 68 engage respectively the top shelf 65 and a ceiling 69 and by manipulating the body member of the device the pads 68 can be extended into gripping engagement with the engaged surfaces and thereby maintain the stacked members tightly engaged against displacement. When it is desired to dismantle the stacked arrangement, the tightening post device 67 can be easily released and the stacked members manipulated in any manner desired.

Where it is desired to have subsidiary shelving between the main shelving panels such as the panels 61 and 62, a subsidiary shelf 70 may be mounted between adjacent ones of the pillar blocks 12' as by means of end portion 71 of the shelf 70 engaged in complementary horizontal shelf slot 72 in the pillar block 12'. To make use of the supplementary shelf 70 as a structural stabilizing member, the end 71 coupled in the slot 72 may be of generally dovetail shape and the slot 72 of complementary dovetail shape so that the shelf 70 can be assembled with the pillar block 12' by sliding the coupling flange edge 71 horizontally into the groove 72. Separation can then be effected only by sliding the shelf 70 out of the coupled relationship. Thereby a positive interlocked stable connection is effected resisting displacement of the stacked elements.

Figure 7:
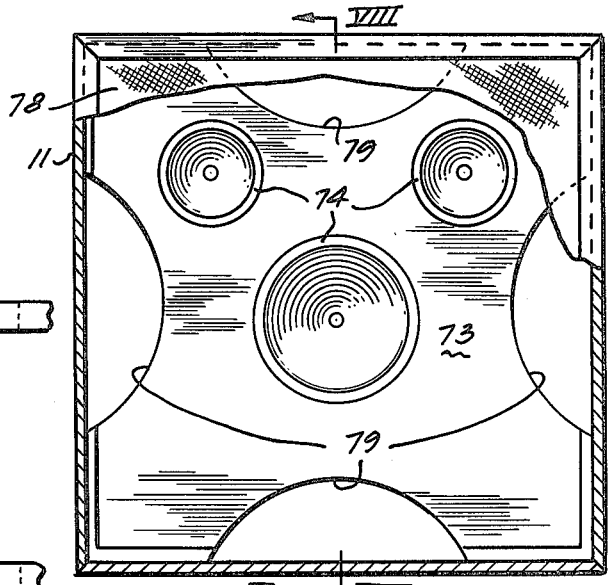
FIG. 7 is a front elevational view, partially broken away and in section of a novel stereo speaker module.
Figure 8:
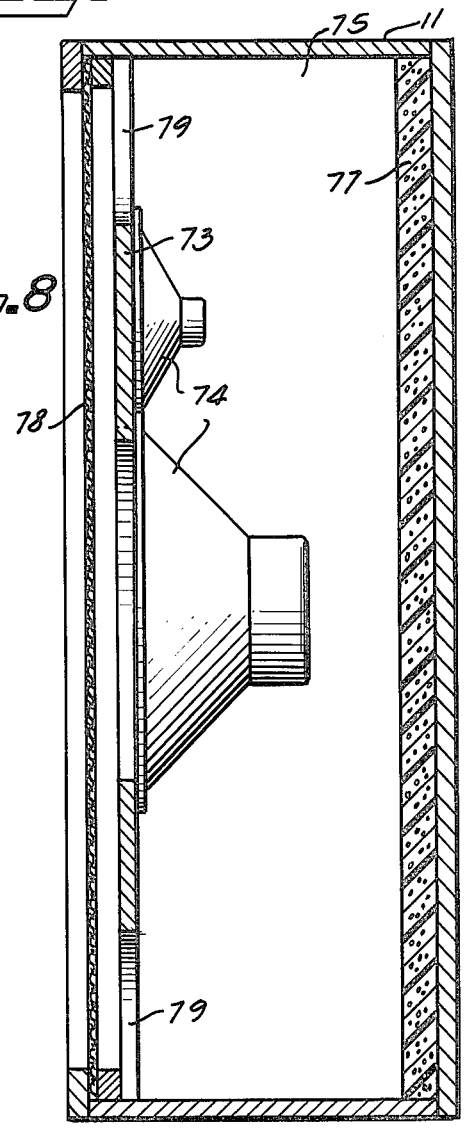
FIG. 8 is an enlarged vertical sectional detail view taken substantially along the line VIII—VIII of FIG. 7.

In order to minimize vibration during operation of the speaker assembly in the article 11, the construction shown in FIGS. 7 and 8 has been found desirable. As is usual, within the speaker cabinet there is mounted adjacent to the front opening a speaker mounting board 73 on which speakers 74 of selected sizes are mounted, there being a substantial back pressure space 75 behind the board 73 and vibration damping material 77 on the inner face of the back closure panel of the cabinet. As is customary, across the front of the front opening and in front of the mounting board 73, a porous screen 78 is provided. A substantial improvement is provided for releasing back pressure from within the space 75 in the operation of the speakers 74. One or more substantial recessed cut-outs 79 in the edges of the mounting board 73 eliminate any problem from back pressure even where speaker volume is turned up to the loudest decibel value of which the speakers are capable. In contrast with the conventional porthole and tube arrangement speaker blow out has been experienced where the speakers were turned up to maximum volume. In addition, it has been found that with the side edge cut-out ports 79, there appears to be a better sound distribution or equalization and truer, softer tone quality from the speaker unit.

It will be understood that variations and modifications may be effected without departing from the spirit and scope of the novel concepts of this invention.

I claim as my invention:

1. In combination in modular furniture structure:

a modular pillar block having top and bottom load bearing surfaces;

at least one of said surfaces having a recessed seat for supporting engagement with complementary surface area of a modular article of furniture;

a base;

said pillar block having its bottom load bearing surface in engagement with said base and said one surface being at the top;

a modular article of furniture having a complementary surface in supportive engagement in said recessed seat;

a second modular pillar block having top and bottom load bearing surfaces and having its bottom load bearing surface on said base spaced from said first pillar block;

the top load bearing surface of said second pillar block having a recessed seat;

a modular article of furniture having a complementary surface in supportive engagement in said recessed seat of the second pillar block;

supporting means mounted on and between said modular articles of furniture;

said modular articles of furniture having corners projecting toward one another in spaced relation;

and said supporting means carried on and between said articles comprising a shelf structure having means in supportive engagement with said corners.

2. A modular furniture structure according to claim 1, wherein at least one of said articles of furniture comprises a sound reproducing speaker cabinet having a mounting board mounted therein and carrying at least one loud speaker, said board being spaced from a back wall of the cabinet, and said board having substantial size back pressure relieving openings in side margins thereof.

3. A modular furniture structure according to claim 1, wherein said shelf structure has a space therein for reception of a stereo unit or the like.

4. A modular furniture structure according to claim 1, comprising a sound reproducing unit mounted on said shelf structure.

5. A modular furniture structure according to claim 1, wherein said modular articles of furniture comrise respective speaker units.

6. A modular furniture structure according to claim 1, wherein said modular articles of furniture have mounted thereon additional pillar blocks, and additional articles of furniture mounted on said additional pillar blocks.

7. In combination in modular furniture structure:

a modular pillar block having top and bottom load bearing surfaces;

at least one of said surfaces having a recessed seat for supporting engagement with complementary surface area of a modular article of furniture;

a base;

said pillar block having its bottom load bearing surface in engagement with said base and said one surface being at the top;

a modular article of furniture having a complementary surface in supportive engagement in said recessed seat;

a second modular pillar block having top and bottom load bearing surfaces and having its bottom load bearing surfaces on said base spaced from said first pillar block;

the top load bearing surface of said second pillar block having a recessed seat;

a modular article of furniture having a complementary surface in supportive engagement in said recessed seat of the second pillar block;

supporting means mounted on and between said modular articles of furniture;

a sound reproducing unit;

and vibration isolating cushioning means mounting said sound reproducing unit on said supporting means carried on and between said modular articles of furniture.

8. A structure according to claim 7, wherein said recessed seat is of substantially V-shape defined by converging bearing surface areas.

9. A modular furniture structure according to claim 7, wherein said supporting means comprise a shelf which is mounted on top of said modular articles of furniture, said vibration isolating cushioning means comprising suspension means mounted on the underside of the said shelf and carrying a shelf on which said sound reproducing unit is mounted.

10. A modular furniture structure according to claim 7, comprising additional pillar blocks mounted on said modular articles of furniture, and said supporting means comprising a member mounted on and spanning said additional pillar blocks.

11. A modular furniture structure according to claim 7, wherein at least one of said modular articles of furniture comprises a sound reproducing speaker cabinet having a mounting board mounted therein and carrying at least one loud speaker, said board being spaced from a back wall of the cabinet, and said board having substantial size back pressure relieving openings in side margins thereof.

12. A combination according to claim 11, wherein said openings are in the form of cut outs located at spaced intervals about the perimeter of said board.

13. A modular furniture structure according to claim 7, including means for retaining the articles of furniture in place in said seats.

14. A modular furniture structure according to claim 13, wherein said retaining means comprise pressure sensitive adhesive carried by surface areas of said seats.

15. A modular furniture structure according to claim 7, wherein said modular articles of furniture have corners projecting toward one another in spaced relation, and said supporting means carried on and between said articles comprises a shelf structure having means in supporting engagement with said corners.

16. A modular furniture structure according to claim 15, wherein said shelf structure has a hollow space for receiving an article therein.

17. A modular furniture structure according to claim 15, wherein said shelf structure has a top surface and said vibration isolating cushioning means being mounted on said top surface.

18. A modular furniture structure, comprising:

a modular pillar block having top and bottom load bearing end surfaces and at least a pair of opposite upright faces adapted to face forwardly and rearwardly, respectively;

at least one of said load bearing end surfaces having a recessed channel-like seat extending entirely substantially straight across said one surface and opening at its opposite ends through said faces and adapted for stable supportive engagement with complementary surface area of a modular article of furniture of such dimensions that, when said complementary surface area is received in said seat, portions of the article of furniture can project freely from and beyond the opposite ends of said channel-like seat and in overhanging relation to said opposite faces;

a base;

said pillar block having its bottom load bearing surface in engagement with said base and said one surface being at the top;

a modular article of furniture having a complementary surface in supportive engagement in said recessed seat;

a second modular pillar block having top and bottom load bearing surfaces and having its bottom load bearing surface on said base spaced from said first pillar block;

the top load bearing surface of said second pillar block having a recessed seat running out at opposite vertical faces of said second pillar block;

a modular article of furniture having a complementary surface in supportive engagement in said recessed seat of the second pillar block;

supporting means mounted on and between said modular articles of furniture;

said modular articles of furniture having corners projecting toward one another in spaced relation;

and said supporting means carried on and between said articles comprising a shelf structure having means in supportive engagement with said corners.

19. A modular furniture stucture, comprising:

a modular pillar block having top and bottom load bearing end surfaces and at least a pair of opposite upright faces adapted to face forwardly and rearwardly, respectively;

at least one of said load bearing end surfaces having a recessed channel-like seat extending entirely substantially straight across said one surface and opening at its opposite ends through said faces and adapted for stable supportive engagement with complementary surface area of a modular article of furniture of such dimensions that, when said complementary surface area is received in said seat, portions of the article of furniture can project freely from and beyond the opposite ends of said channel-like seat and in overhanging relation to said opposite faces;

a base;

said pillar block having its bottom load bearing surface in engagement with said base and said one surface being at the top;

a modular article of furniture having a complementary surface in supportive engagement in said recessed seat;

a second modular pillar block having top and bottom load bearing surfaces and having its bottom load bearing surface on said base spaced from said first pillar block;

the top load bearing surface of said second pillar block having a recessed seat running out at opposite vertical faces of said second pillar block;

a modular article of furniture having a complementary surface in supportive engagement in said recessed seat of the second pillar block;

supporting means mounted on and between said modular articles of furniture;

a sound reproducing unit;

and vibration isolating cushioning means mounting said sound reproducing unit on said supporting means carried on and between said modular articles of furniture.

* * * * *